United States Patent [19]

Witt et al.

[11] Patent Number: 4,691,636

[45] Date of Patent: Sep. 8, 1987

[54] EXPLODING MISSILE

[75] Inventors: Wolfram Witt; Hendrik Lips, both of Düsseldorf; Herbert Scholles, Meerbusch; Raimund Schweiger, Munich, all of Fed. Rep. of Germany

[73] Assignee: Rheinmetall GmbH, Düsseldorf, Fed. Rep. of Germany

[21] Appl. No.: 887,176

[22] Filed: Jul. 17, 1986

Related U.S. Application Data

[63] Continuation-in-part of Ser. No. 624,042, Jun. 25, 1984, Pat. No. 4,622,900.

[30] Foreign Application Priority Data

Jun. 25, 1983 [DE] Fed. Rep. of Germany ..... 3322927

[51] Int. Cl.[4] ..... F42B 13/00; F42B 1/02; F42B 25/02

[52] U.S. Cl. ..... 102/387; 102/211; 102/214; 102/476

[58] Field of Search ..... 102/211–214, 102/475, 476, 386, 387, 388, 393, 306

[56] References Cited

U.S. PATENT DOCUMENTS

| | | | |
|---|---|---|---|
| 2,432,920 | 12/1947 | McKay et al. | 102/387 |
| 3,439,610 | 4/1969 | Myers | 102/388 X |
| 3,527,167 | 9/1970 | Morse | 102/476 X |
| 3,818,833 | 6/1974 | Throner | 102/214 X |
| 3,875,862 | 4/1975 | Fischer et al. | 102/425 |
| 4,050,381 | 9/1977 | Heinemann | 102/476 X |
| 4,160,415 | 7/1979 | Cole | 102/214 |
| 4,207,841 | 6/1980 | Bloomer | 102/214 |
| 4,296,685 | 10/1981 | Romer | 102/387 |

FOREIGN PATENT DOCUMENTS

| | | | |
|---|---|---|---|
| 2856610 | 1/1983 | Fed. Rep. of Germany | 102/476 |
| 2478297 | 9/1981 | France | 102/387 |
| 1444029 | 7/1976 | United Kingdom | 102/387 |

*Primary Examiner*—David H. Brown

[57] ABSTRACT

An exploding missile has a casing and a parachute attached to the casing for making it move in a predetermined direction relative to the casing after launch. A charge in the casing has a projectile-forming front face, facing forward in the travel direction. An antenna is provided on the casing behind the front face and charge and is displaceable between a retracted position wholly behind the charge and an extended position projecting laterally therefrom and directed at least generally forwardly in the direction past the charge. An actuator is connected between the casing and the antenna for moving same from the retracted into the extended position after launch of the missile. A controller including a receiver connected to the antenna and a detonator in the charge detects the distance to a target in front of the missile and explodes the charge when a predetermined distance is detected or the target is otherwise sensed. The antenna is deployed after launch in a position capable of scanning forward of the obstacle to the secondary projectile, when that goes off.

5 Claims, 6 Drawing Figures

EXPLODING MISSILE

CROSS-REFERENCE TO RELATED APPLICATION

This application is a continuation-in-part application of our copending application Ser. No. 624,042, filed June 25, 1984, and entitled EXPLODING MISSILE, now U.S. Pat. No. 4,622,900.

FIELD OF THE INVENTION

The present invention relates to an exploding projectile or bomb. More particularly this invention concerns such a missile which detonates or explodes to form a secondary projectile as it nears its target.

BACKGROUND OF THE INVENTION

A missile that is dropped from an airplane or fired from a large artillery piece so as to descend onto its target while suspended from a parachute can be provided with a target-sensing unit that explodes a charge in the missile when it approaches the target. This charge therefore lies behind a projectile- or shrapnel-forming layer with respect to the downward direction of travel of the missile, so that when it explodes this layer is propelled in the form of one or more pieces at the target. Such devices are particularly effective against armored vehicles which cannot penetrate by projectiles that have moved through a long distance and, therefore, lost most of their speed and momentum.

Typically the target-sensing device is a radar-like transmitter and receiver, most often one that detects the distance to the underlying ground so that the charge can be detonated at the optimum altitude, which is fairly low and impossible to detect accurately by a simple barometer-type altimeter. The device could also be a simple receiver that detonates as it approaches a signal-emitting target or beacon thereon.

As described in German Pat. No. 2,353,566 which corresponds to British Pat. No. 1,444,029, the target-sensing unit comprises at least one antenna for transmitting and receiving, a transmitter, a receiver, and circuitry connected between the transmitter and receiver and to the detonator in the charge when the target is appropriately sensed. At least the antenna of this unit is provided, relative to the normal direction of travel of the missile, in front of the charge and the element forming the secondary projectile or projectiles when the charge is detonated. Thus in a system wherein the lower surface is provided with a hard layer that breaks up and forms shrapnel, the energy of at least some of this shrapnel will be absorbed as it impacts the back of the target-sensing unit. Clearly this reduces the effectiveness of the secondary detonation.

The effective size of the antenna can be reduced as described in copending and coassigned application Ser. No. 628,751, filed on July 9, 1984 (now U.S. Pat. No. 4,584,943) connecting the antenna to the radar transceiver by means of a tubular waveguide centered on an axis parallel to the projectile travel direction. This waveguide is imbedded in the charge and is in fact also packed with explosive which itself can be a neutral dielectric. Such an arrangement has several advantages, but still does at least minimally block the forward face of the missile that becomes the secondary projectile or projectiles.

OBJECTS OF THE INVENTION

It is therefore an object of the present invention to provide an improved exploding missile.

Another object is the provision of such an exploding missile which overcomes the above-given disadvantages, that is which does not waste some of its secondary detonation as described above.

SUMMARY OF THE INVENTION

An exploding missile according to the invention has a casing and means such as a parachute attached to or fins on the casing for making it move in a predetermined direction relative to the casing after launch. A charge in the casing has a projectile-forming front face, that is one facing forward in the travel direction. An antenna is provided on the casing behind the front face and charge and so as to be displaceable between a retracted position wholly behind the charge and an extended position projecting laterally therefrom and directed at least generally forwardly in the direction past the charge. An actuator is connected between the casing and the antenna for moving same from the retracted into the extended position after launch of the missile. A controller including a receiver connected to the antenna and detonator in the charge detects the distance to or presence of a target in front of the missile and explodes the charge when the target is in range.

Thus the antenna is deployed after launch in a position capable of scanning forward of the projectile, but at a location where it presents no blockage or obstacle to the secondary projectile, when that goes off.

The antenna of this invention has a forwardly concave and center cup forming part of an arm disposed behind the charge in a retracted position. Two arms forming a plurality of antenna segments are displaceable between retracted and outwardly swung positions on the can. Together, the cup and the segments form, when the segments are deployed in their outwardly swung positions, a forwardly directed antenna that is perfect for the forward scanning required by the microwave equipment of this type.

This is an extremely simple system, and can be simplified further by forming the segments as metallic or microwave-reflective material on the inner or outer surface of appropriate segmental portions of the arms.

In accordance with this invention the antenna is pivotal about an axis generally parallel to the direction between the inner and outer position. Two such antennas can be provided symmetrically opposite each other on the casing with one of the antennas being connected to the receiver, and the other to a transmitter forming a distance-detecting radar unit.

DESCRIPTION OF THE DRAWING

The above and other features and advantages will become more readily apparent from the following, reference being made to the accompanying drawing in which.

DETAILED DESCRIPTION

Figure 1:
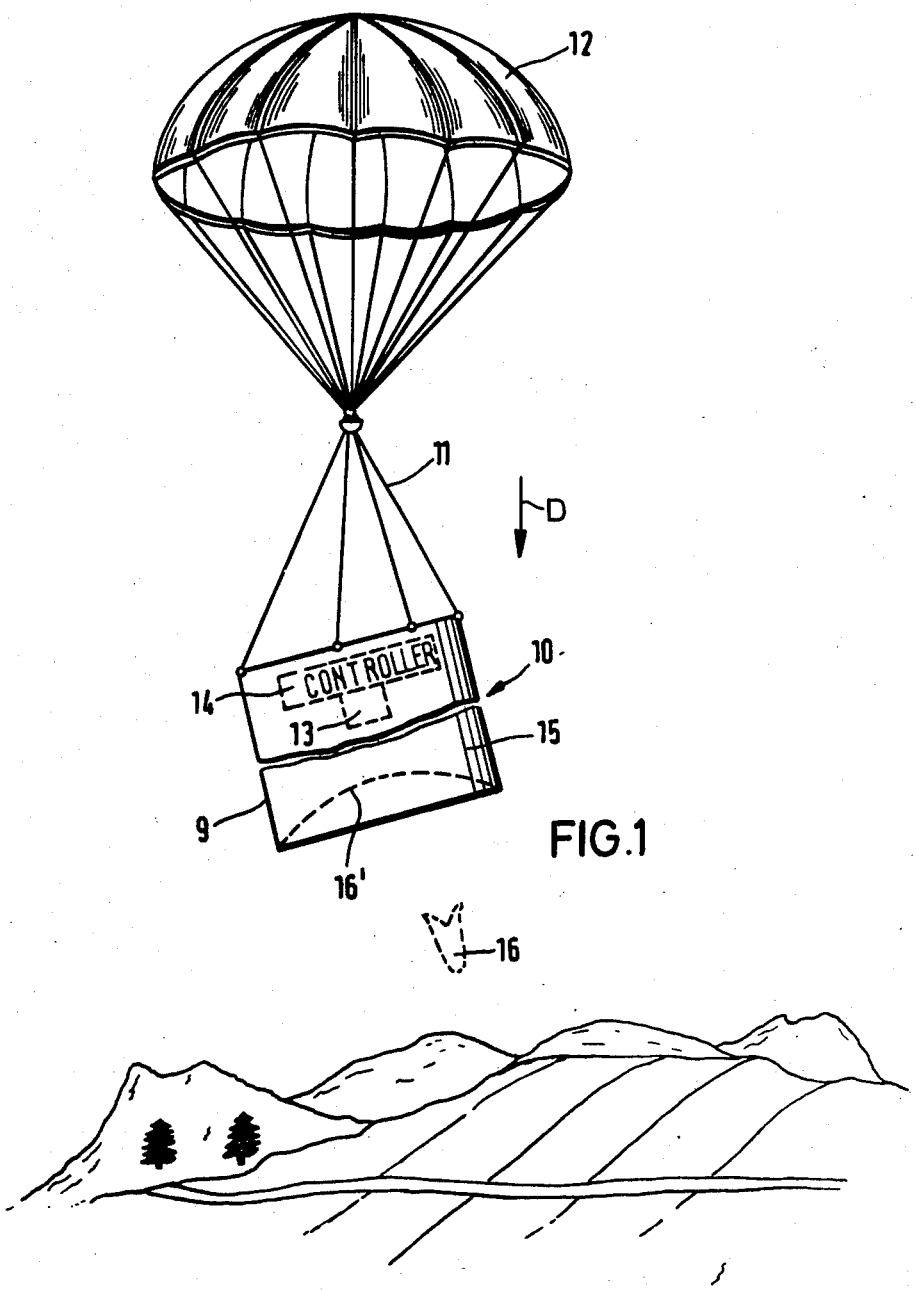
FIG. 1 is a perspective view of the missile according to the invention.
Figure 2:
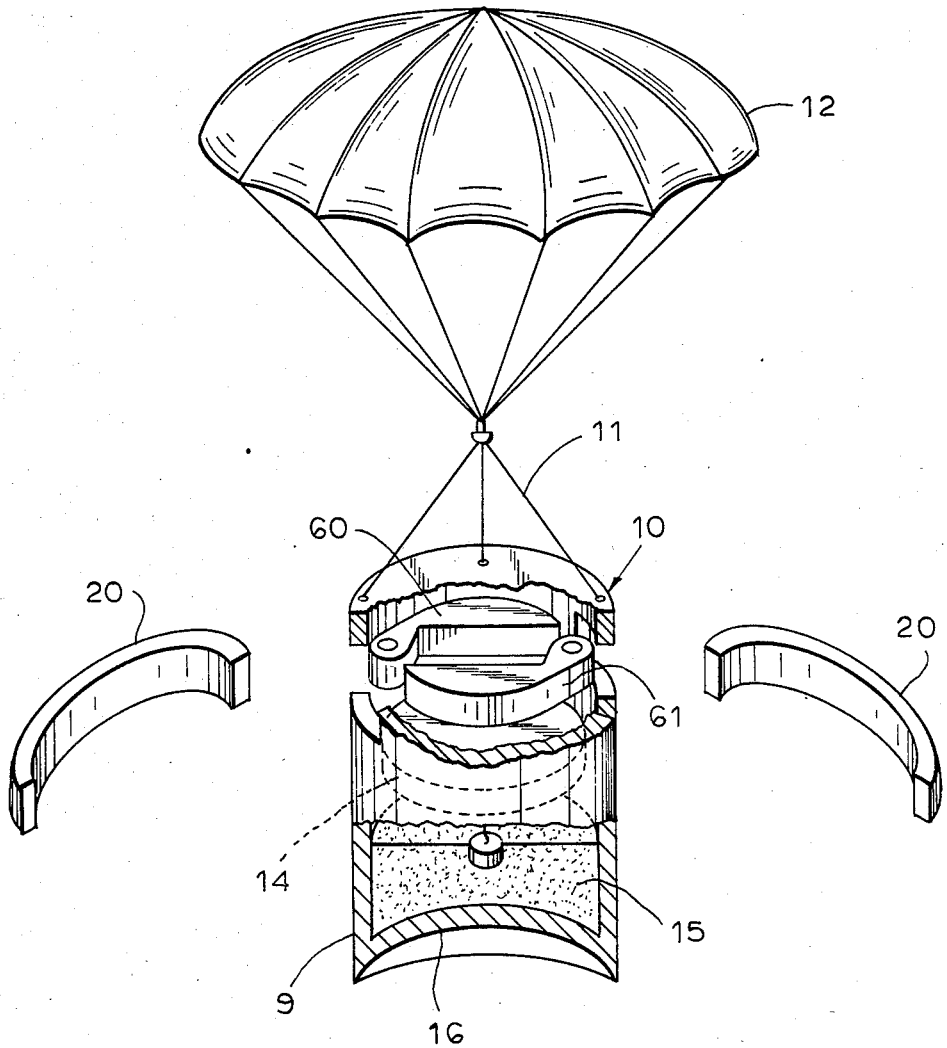
FIG. 2 is a partly sectional explosive and perspective view through the missile in the prelaunch or predeployment position.

As seen in FIGS. 1 and 2 a missile 10 according to this invention has a basically cylindrical casing or can 9 having via suspension lines 11 from a parachute 12 so as to fall in a direction D. The casing 9 contains a large explosive charge 15 having a forwardly cupped front face 16 that forms one or more secondary projectiles when exploded by detonator 13 under the control of a controller 14 that detects the proximity of the target or of the ground.

Figure 3:
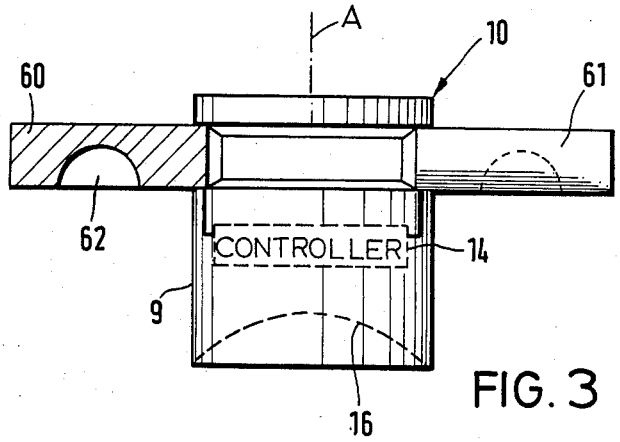
FIG. 3 is a side-elevational view partially in section of a portion of the missile according to this invention in the postlaunch phase with the antenna deployed.

As shown in FIGS. 2 to 5 the can 9 is provided with two identical swing-out arms 60 and 61 behind the charge 14 and pivotal about respective axes 60' and 61' parallel to the direction D and diametrically oppositely flanking the axis A of the can 9. Each of these swing-out arms 60 and 61 is formed as shown in FIG. 3 with an antenna cavity 62 having a metallic microwave reflecting coating that is forwardly directed. If only one antenna 62 is needed, two arms are still provided to balance the can 9. Otherwise one arm 60 can have an antenna 62 for the receiver and the other arm 61 the antenna 62 for the transmitter.

Figure 4:
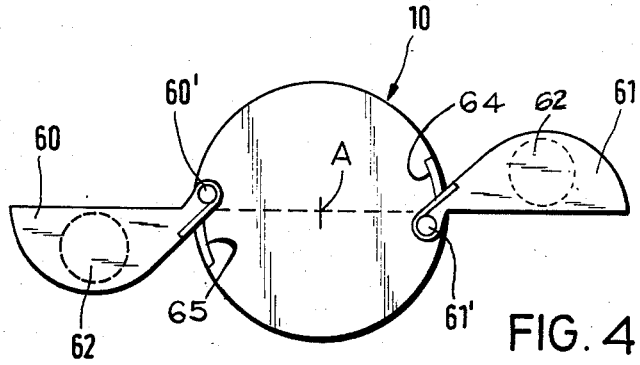
FIG. 4 is a top view of the missile of FIG. 3.
Figure 5:
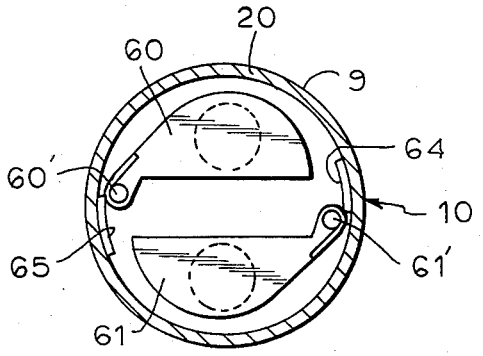
FIG. 5 is a top view showing the antenna wings in a retracted position.
Figure 6:
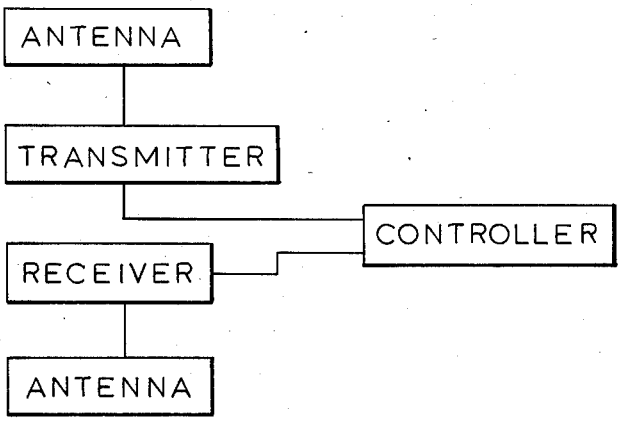
FIG. 6 is a schematic drawing illustrating the manner in which the various components of the arrangement of the invention are interconnected.

The means for effecting the outward swinging of the arms 60 and 61 from the retracted position illustrated in FIGS. 2 and 5 to the extended position illustrated in FIGS. 3 and 4 is provided by a pair of torsion springs 64, 65. One end (arm) of each torsion spring abuts against the inner wall surface of the can 9 of the missile 10, whereas the other end abuts against the respective inner wall of the arms 60, 61. As can be seen in FIG. 2 of the drawing the peripheral wall of the can 9 has a pair of arcuate wall portions 20 which when explosively ejected expose openings to accommodate each arm 60, 61, so that it can be swung outwardly by the torsion springs 60, 61. The means for effecting the outward swinging can also take the form of a piston-cylinder unit (not illustrated).

The axes 60', 61' extend from the upper portion of the missile 10 above the pair of arms 60, 61 to the portion below said pair of arms, so that after the wall portions 20 have been removed and the pair of arms 60, 61 have been swung outwardly the integrity of the assembly of the upper and lower portions is maintained.

Although a single embodiment of the invention has been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

We claim:

1. An exploding missile comprising:

a casing;

means attached to the casing for making it move in a predetermined direction relative to the casing after launch;

a charge in the casing having a projectile-forming front face;

an antenna on the casing behind the front face and charge and displaceable between a retracted position wholly behind the charge and an extended position projecting laterally therefrom and directed at least generally forwardly in the direction past the charge;

actuation means connected between the casing and the antenna for moving same from the retracted into the extended position after launch of the missile; and control means including a receiver connected to the antenna and a detonator in the charge for detecting the distance to a target in front of the missile and exploding the charge when a predetermined distance is detected.

2. The exploding missile defined in claim 1, wherein the control means further comprises a microwave transmitter connected to the antenna and working radar-fashion with the receiver.

3. The exploding missile defined in claim 1, wherein the antenna is pivotal about an axis generally parallel to the direction of movement of the antenna between the inner and outer position.

4. The exploding missile defined in claim 3, wherein two such antennas are provided symmetrically opposite each other on the casing with one of the antennas being connected to the receiver, the missile further comprising a transmitter connected to the other antenna and to the control means.

5. The exploding missile defined in claim 3, wherein the actuation means is formed by a pair of torsion springs which are coaxial with the pivot axes of said two antennas, each torsion spring has a pair of ends, a first one of which abuts against the antenna and the other end abuts against the inner wall surface of the casing.

* * * * *